US010472803B2

(12) United States Patent
Wei

(10) Patent No.: US 10,472,803 B2
(45) Date of Patent: Nov. 12, 2019

(54) SYSTEM AND METHOD FOR DETERMINING STALE TERRAIN VALUE OF WORKSITE

(71) Applicant: Caterpillar Inc., Peoria, IL (US)

(72) Inventor: Mo Wei, Dunlap, IL (US)

(73) Assignee: Caterpillar Inc., Peoria, IL (US)

( * ) Notice: Subject to any disclaimer, the term of this patent is extended or adjusted under 35 U.S.C. 154(b) by 276 days.

(21) Appl. No.: 15/670,086

(22) Filed: Aug. 7, 2017

(65) Prior Publication Data

US 2019/0040607 A1 Feb. 7, 2019

(51) Int. Cl.

| | |
|---|---|
| ***E02F 9/20*** | (2006.01) |
| ***E02F 9/26*** | (2006.01) |
| ***E02F 3/84*** | (2006.01) |
| ***E02F 3/76*** | (2006.01) |

(52) U.S. Cl.

CPC ..... *E02F 9/205* (2013.01); *E02F 3/84* (2013.01); *E02F 3/841* (2013.01); *E02F 9/262* (2013.01); *E02F 3/7604* (2013.01)

(58) Field of Classification Search

CPC ... E02F 9/205; E02F 3/841; E02F 3/84; E02F 9/262; E02F 3/7604

See application file for complete search history.

(56) References Cited

U.S. PATENT DOCUMENTS

| | | | | |
|---|---|---|---|---|
| 9,163,384 | B2 | 10/2015 | Stratton et al. | |
| 9,297,147 | B1 | 3/2016 | Wei et al. | |
| 9,988,787 | B1 * | 6/2018 | Wang | G01S 19/42 |
| 10,093,355 | B1 * | 10/2018 | Wang | B62D 11/003 |
| 2012/0139325 | A1 | 6/2012 | Norberg et al. | |
| 2017/0138016 | A1 * | 5/2017 | Wei | E02F 9/2045 |
| 2017/0357006 | A1 * | 12/2017 | Ohrlund | A01D 34/008 |
| 2018/0038082 | A1 * | 2/2018 | Hashimoto | E02F 3/7609 |
| 2018/0258610 | A1 * | 9/2018 | Elkins | B60W 30/10 |
| 2018/0341267 | A1 * | 11/2018 | Wei | E02F 9/264 |
| 2018/0341268 | A1 * | 11/2018 | Taylor | E02F 3/7604 |
| 2018/0347154 | A1 * | 12/2018 | Martinsson | E02F 3/431 |
| 2019/0033877 | A1 * | 1/2019 | Wei | G05D 1/0217 |
| 2019/0138016 | A1 * | 5/2019 | Ogihara | E02F 9/2054 |

* cited by examiner

*Primary Examiner* — Dale W Hilgendorf

*Assistant Examiner* — Alexander Connor Larkin Bost

(57) ABSTRACT

A control system for determining a stale terrain value for use by an autonomous machine is provided. The control system includes a controller associated with the autonomous machine operating on a work surface. The controller is configured to receive position data associated with the autonomous machine from a position sensing system. The controller is configured to receive data related to a dump operation to be performed by the autonomous machine. The data includes a distance between a start location and an end location, a distance between two adjacent piles of material, and an average speed of travel of the autonomous machine. The controller is configured to determine the stale terrain value associated with the work surface. The controller is configured to trigger a control signal for shutting down the dump operation of the autonomous machine on approaching the stale terrain value based on receiving an operator input.

20 Claims, 4 Drawing Sheets

SYSTEM AND METHOD FOR DETERMINING STALE TERRAIN VALUE OF WORKSITE

TECHNICAL FIELD

The present disclosure relates to a system and method for control of an autonomous machine and more particularly to a system and method for determining a stale terrain value of a worksite.

BACKGROUND

Autonomous or semi-autonomous machines, such as dozers, are used to perform a number of earthmoving operations at a worksite. In such machines, minimal operator supervision may be required for operating the machine. Sometimes, the operator may be seated at a remote location and may operate a fleet of the machines from the remote location at the same time.

Dozers may be used to perform earthmoving operations that involve three distinct phases known as dig, carry, and dump. Operations may involve either push-to-edge or backstacking a number of piles of material on a surface of the worksite. Generally, a stale terrain value limit may be set for the dump operations near an edge such that on approaching the stale terrain value limit, the operator may need to intervene to check that the dozer is performing tasks as required. Such intermittent checking of the terrain on which the dozer operates may be required when more than one of the dozers operates at the worksite, since movement of other dozers may affect certain aspects of the terrain.

In backstacking operations, in which sometimes multiple layers may be thrilled on the work surface, each layer including a number of piles of the material, it may be essential to gain confidence on the terrain on which the dozer operates. A stale terrain is indicative that the dozer has not visited and/or updated the terrain for a predefined period of time, resulting in lower confidence in the terrain. Presence of stale terrain on the worksite is assumed to exist on approaching the stale terrain value limit.

However, setting an optimal stale terrain value limit may be challenging, if the stale terrain value limit is set low, the operator may need to frequently check the operation of the dozer, increasing stress and pressure on the operator, sometimes leading to delays in operation and affecting an overall productivity of the system. On the other hand, if the stale terrain value limit is set high, the operator may rarely check the system. In some situations, untoward changes in the terrain may take place due to presence of other dozers at the worksite or other reasons, leading to undesired terrain characteristics. Hence, there is a need to determine an optimum timing strategy for operator intervention in controlling the autonomous operation of the machine.

U.S. Pat. No. 9,163,384 describes a system for automated control of a machine. The system has a ground engaging work implement including an implement load sensor system. A controller determines a change in terrain based at least in part upon a change in the load on the ground engaging work implement. If the change in terrain exceeds a stale terrain value, the controller generates an alert command signal.

SUMMARY OF THE DISCLOSURE

In one aspect of the present disclosure, a control system for determining a stale terrain value for use by an autonomous machine is provided. The control system includes a controller associated with the autonomous machine operating on a work surface. The controller is configured to receive position data associated with the autonomous machine from a position sensing system. The controller is configured to receive data related to a dump operation to be performed by the autonomous machine. The data includes a distance between a start location and an end location, a distance between two adjacent piles of material, and an average speed of travel of the autonomous machine. The controller is configured to determine the stale terrain value associated with the work surface based on the received position data and the data related to the dump operation. The controller is configured to trigger a control signal for shutting down the dump operation of the autonomous machine on approaching the stale terrain value based on receiving an operator input.

In another aspect of the present disclosure, a method for a stale terrain value associated with an autonomous machine. The method includes receiving, by a controller, position data associated with the autonomous machine from a position sensing system. The method includes receiving, by the controller, data related to a dump operation to be performed by the autonomous machine. The data includes a distance between a start location and an end location, a distance between two adjacent piles of material, and an average speed of travel of the autonomous machine. The method includes determining, by the controller, the stale terrain value associated with the work surface based on the received position data and the data related to the dump operation. The method includes triggering, by the controller, a control signal for shutting down the dump operation of the autonomous machine on approaching the stale terrain value based on receiving an operator input.

In another aspect of the present disclosure, an autonomous machine operating at a worksite is provided. The autonomous machine includes an engine, a worktool for performing a dump operation, and a control system for determining a stale terrain value for use by the autonomous machine. The control system includes a controller associated with the autonomous machine operating on a work surface. The controller is configured to receive position data associated with the autonomous machine from a position sensing system. The controller is configured to receive data related to a dump operation to be performed by the autonomous machine. The data includes a distance between a start location and an end location, a distance between two adjacent piles of material, and an average speed of travel of the autonomous machine. The controller is configured to determine the stale terrain value associated with the work surface based on the received position data and the data associated with the dump operation. The controller is configured to trigger a control signal for shutting down the dump operation of the autonomous machine on approaching the stale terrain value based on receiving an operator input.

Other features and aspects of this disclosure will be apparent from the following description and the accompanying drawings.

DETAILED DESCRIPTION

Wherever possible, the same reference numbers will be used throughout the drawings to refer to the same or the like parts. Also, corresponding or similar reference numbers will be used throughout the drawings to refer to the same or corresponding parts.

Figure 1:
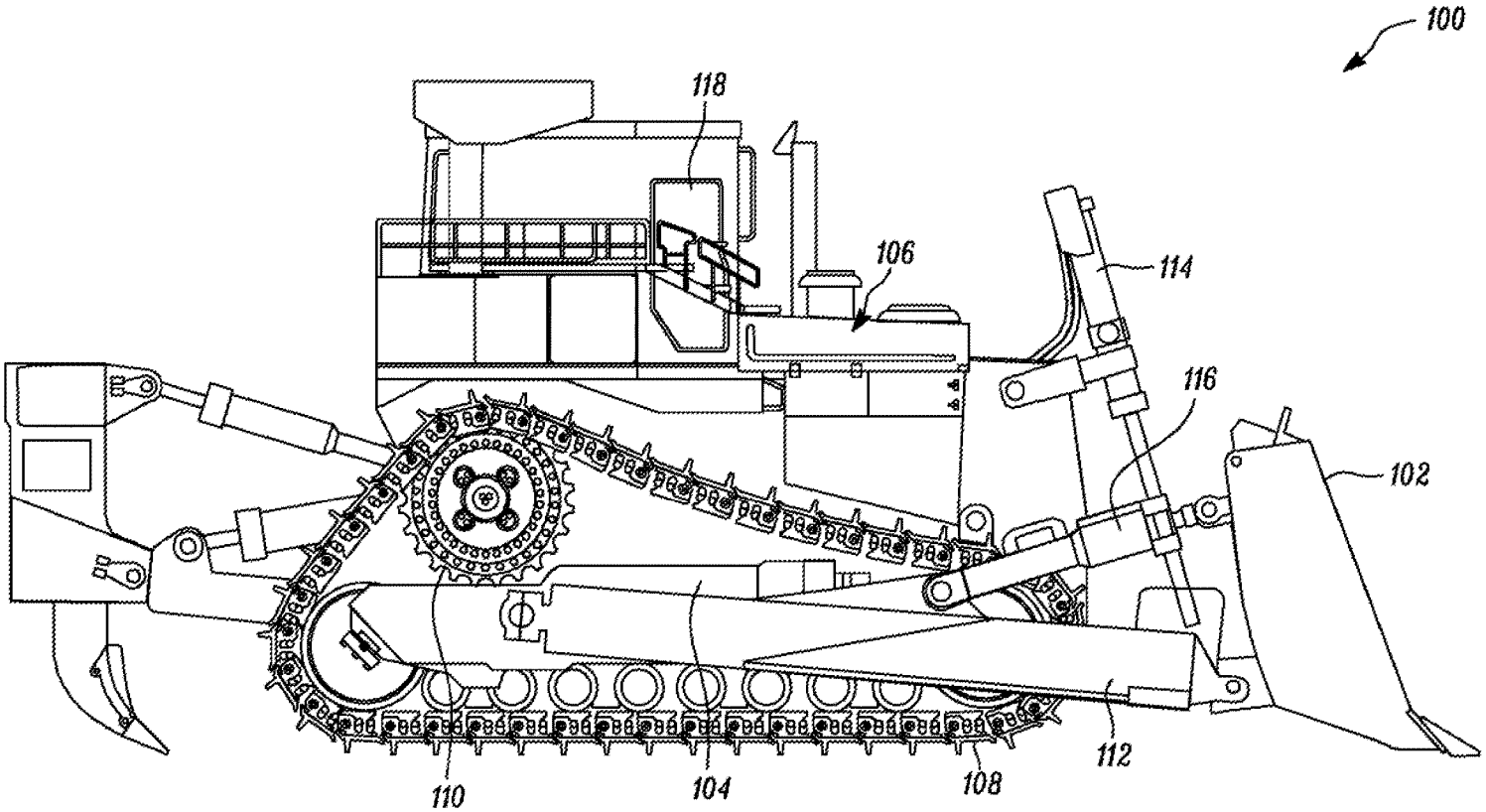
FIG. 1 is a side view of an exemplary machine, according to various concepts of the present disclosure.

FIG. 1 illustrates an exemplary machine 100. The machine 100 is embodied as a dozer. The machine 100 has a ground engaging work implement, that is a blade 102, to push material. The machine 100 includes a frame 104 and a prime mover, such as an engine 106. A ground-engaging drive mechanism such as a track 108 is driven by a drive sprocket 110 on opposite sides of the machine 100 to propel the machine 100. The engine 106 and a transmission (not shown) are operatively connected to the drive sprockets 110, which drive the tracks 108. The systems and methods of the disclosure may be used with any machine propulsion and drivetrain mechanisms applicable in the art for causing movement of the machine 100 including hydrostatic, electric, or mechanical drives.

The blade 102 is pivotally connected to the frame 104 by arms 112 on each side of the machine 100. A first hydraulic cylinder 114 and a second hydraulic cylinder 116 facilitate movement of the blade 102 relative to the frame 104. The machine 100 includes a cab 118 that the operator may physically occupy and provide input to control the machine 100 when needed. The cab 118 may include one or more input devices, such as joystick, through which the operator may issue commands to control the propulsion system and steering system of the machine 100 as well as operate various implements associated with the machine 100. The machine 100 is configured to be operated autonomously or semi-autonomously. Accordingly, the machine 100 may be operated with little human intervention. In some examples, a single operator seated at the remote location may operate one or more of the machines 100 at the same time.

The machine 100 additionally includes multiple implement position sensors (not shown) associated with the first and second hydraulic cylinders 114, 116. The implement position sensors are configured to generate signals of any of a lift, tilt, and/or angle of the first and second hydraulic cylinders 114, 116 respectively.

The present disclosure relates to a control system 200 (see FIG. 2) for determining a stale terrain value for use on the machine 100. An electronic control module (ECM) may control the operation of the machine 100 to perform a number of dump operations on a work surface at a worksite. The present disclosure may be utilized in case of multiple dump operations involving pivot push operations which include backstacking of multiple piles of material on the work surface (see FIG. 3). The control system 200 may monitor a time interval of the autonomous operation of the machine 100 and provides a time strategy for indicating to the operator when to intervene and manually check the otherwise autonomous operation of the machine 100 at the worksite based on the determined stale terrain value.

Figure 2:
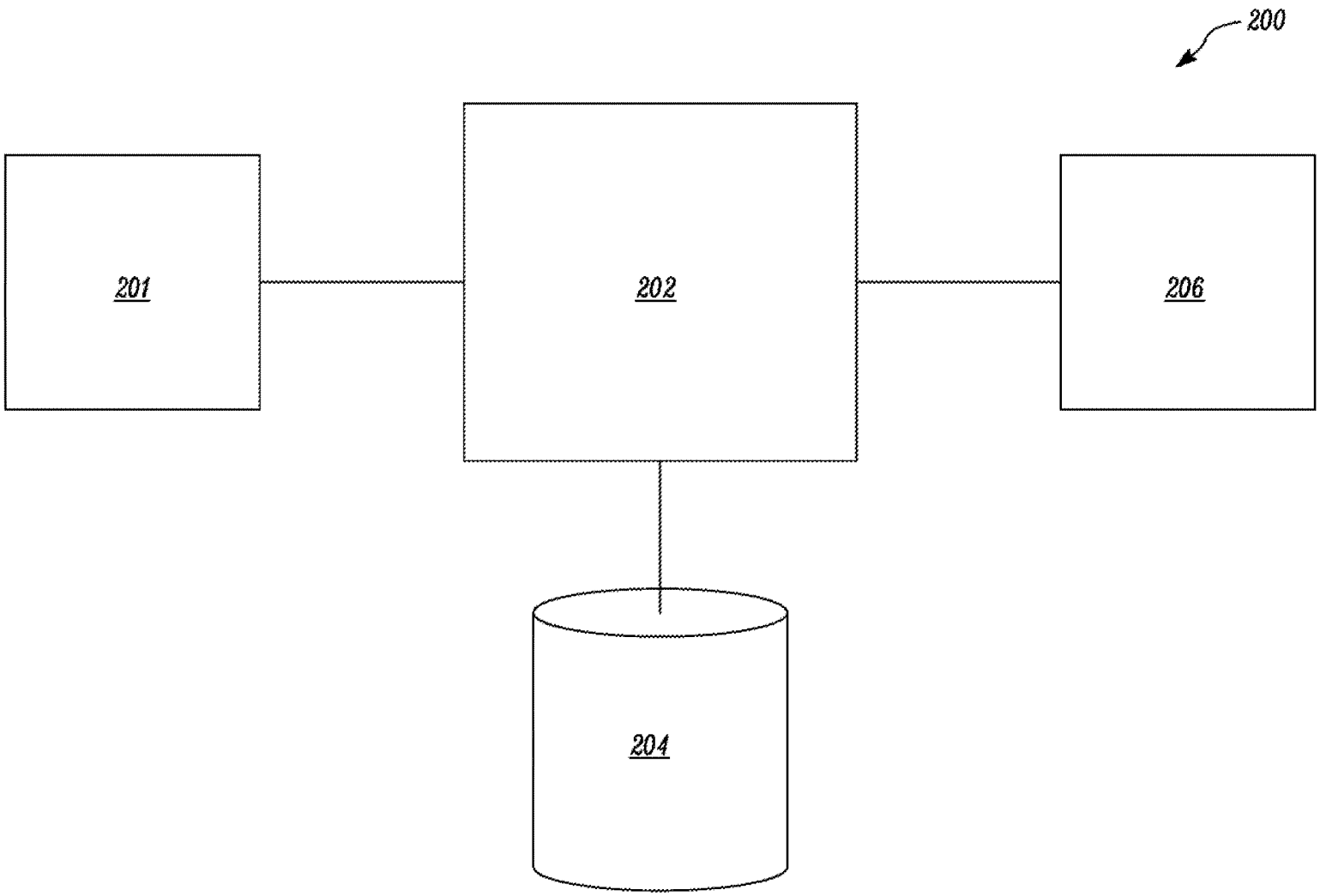
FIG. 2 is a block diagram of a control system associated with the machine of FIG. 1, according to various concepts of the present disclosure.
Figure 3:
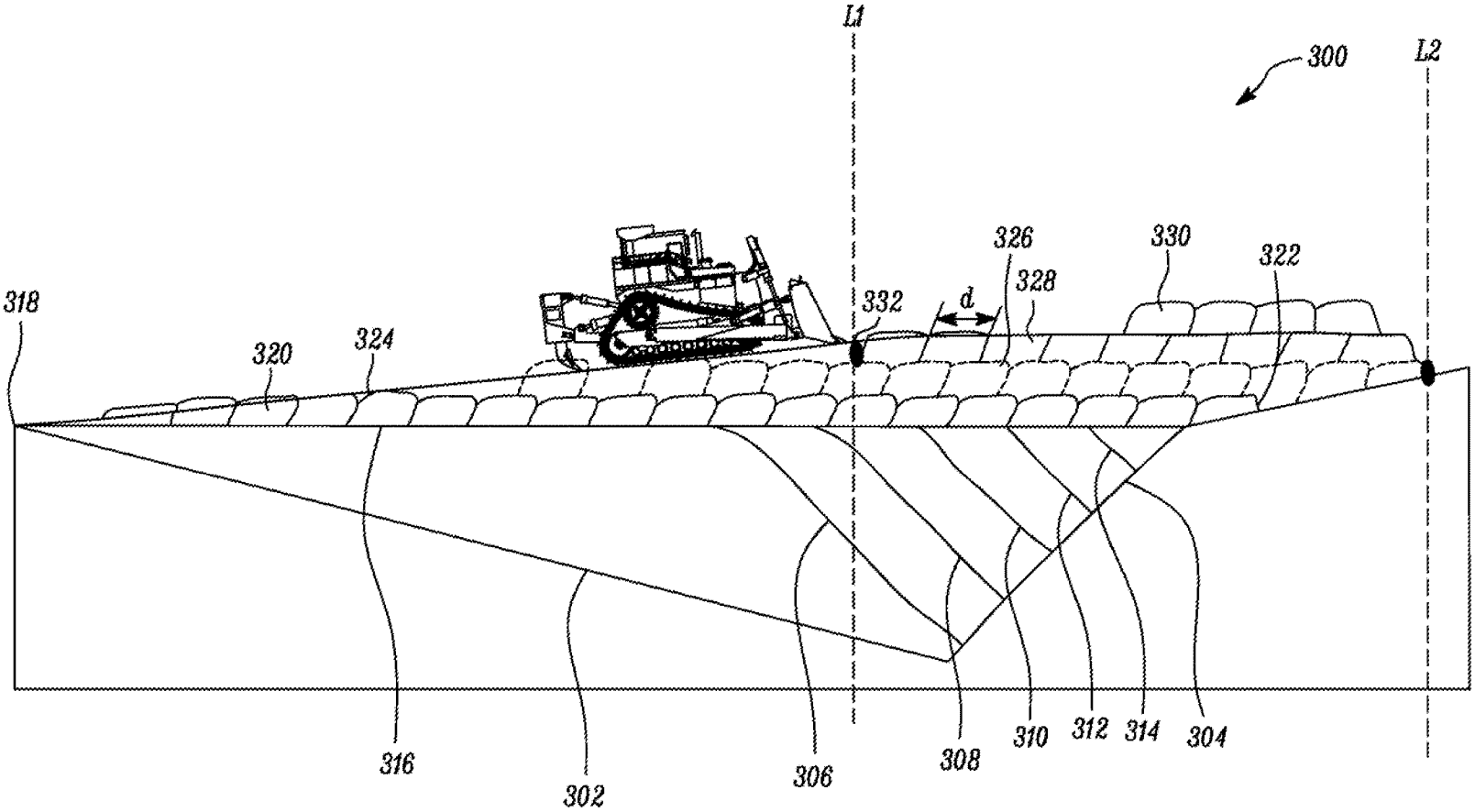
FIG. 3 is a schematic view of a worksite on which the machine operates, according to various concepts of the present disclosure.

Referring to FIGS. 2 and 3, the control system 200 includes a position sensing system 201. The position sensing system 201 is configured to generate position data indicative of a position of the machine 100 relative to the worksite. The position sensing system 201 may include any known position detection system for example, a Global Positioning System (GPS), a perception based system, an Inertial Measurement Unit (IMU), a LIDAR system, and so on. The control system 200 also includes a controller 202. The controller 202 is coupled to the position sensing system 201. The controller 202 receives the position data related to the machine 100 from the position sensing system 201.

The position sensing system 210 may include a plurality of individual sensors that cooperate to provide signals to the controller 202 to indicate the position of the machine 100 at worksite. Further, the controller 202 may also receive signals from the implement position sensor associated with the first and second hydraulic cylinders 114, 116. Accordingly, the controller 202 determines the position of the machine 100 within worksite as well as the orientation of the machine 100 such as heading, pitch, and roll. In doing so, the dimensions of the machine 100 may be stored within the controller 31 with the position sensing system 201 defining a datum or reference point on the machine 100 and the controller 202 using the dimensions to determine an outer boundary of the machine 100 as the machine 100 moves at the worksite.

The controller 202 is also coupled to a database 204. The database 204 may include any known online or offline data storage or data repository for storage of dynamic data related to the dump operations to be performed by the machine 100. In some embodiments, the data stored in the database 204 may be accessible to the machine 100 by logging into a web application. The data includes information related to a start location and an end location for the dump operations to be performed by the machine 100, a distance between two adjacent piles of material for the dumping, and an average speed of travel of the machine 100.

The backstacking operation will now be described in greater detail referring to FIG. 3. FIG. 3 illustrates a portion of an exemplary worksite 300. FIG. 3 shows a condition of the worksite 300 after multiple dump operations are done. The gradual build-up of the material at the worksite 300 resulting in this condition will now be discussed, initially, there may be a void between edges 302 and 304 of the worksite 300. The machine 100 may fill in the void by performing successive dump operations or push-down operations wherein the machine 100 progressively and gradually fills in the material into the void, as represented by edges 306 to 314 that move towards the edge 304, with every next dump operation performed by the machine 100. After the successive dump operations are completed, the work surface on which the machine 100 operates for remaining operations may be defined by a surface 316.

The machine 100 may now perform push-up operations involving backstacking of multiple piles of the material on the surface 316. The present disclosure relates to the determination of the stale terrain value associated with the backstacking operation by the controller 202. The backstacking operations may include creating a number of layers, by dumping piles of the material beginning at the surface 316 from an initial position (closer to the edge 304 and proximate to line L2) of the worksite 300 and moving backwards towards the edge 302 till a final location (closer to the edge 306). The multiple piles of the material dumped on the surface 316 constitute a layer. Other layers may in turn be formed above the said layer.

For example, for layer 320, the machine 100 may begin dumping the pile of material from location 322. The machine 100 continues to dump a number of piles of the material as it moves away from 322 and closer towards the location 318. The worksite 300 may have a predefined grade (see surface 324). Based on the location 318 and the predefined grade, the machine 100 may determine where to stop for the current layer 320, and then proceeds to form the next layer 326 by dumping more piles of the material in a similar manner. Accordingly, the machine 100 may form the layer 326, layer 328, and then layer 330.

The dumping operations may be performed autonomously by the machine 100. It should be noted that while performing the dumping operations, the controller 202 is aware of the position of the machine 100 at the worksite, and the position of the blade 102 (through the position of the first and second hydraulic cylinders 114, 116), enabling the controller 202 to determine that the machine 100 is performing the desired task at the desired location. Also, the controller 202 inherently has confidence on the portion of the terrain that the machine 100 has traversed since the controller 202 is aware of the activities of the machine 100 at the given portions.

The controller 202 is configured to provide the timing strategy for deciding when an operator should intervene to ensure that characteristics of the terrain on which the machine 100 is operating on are as desired. Accordingly, the controller 202 is configured to identify a presence of stale terrain at the worksite 300 that requires manual inspection, based on approaching or exceeding the determined stale terrain value.

This stale terrain value is indicative of terrain that has not been validated or re-stamped by the machine 100 in a predefined time frame, resulting in lower confidence in the terrain. Accordingly, the controller 202 may dynamically compute the stale terrain value based on a number of parameters that will be discussed here. The stale terrain value is determined and computed by the controller 202 based on the data related to the dump operations as follows:

$$x >= k \times \left(\text{Max}\frac{\text{slot length}}{\text{pile spacing}}\right) \times \left(\text{Max}\frac{\text{slot length}}{\text{avg travel speed}}\right) \qquad \text{Equation 1}$$

Where:
x=stale terrain value
k=factor greater than 1
slot length=distance between the start location and the end location
pile spacing=distance between two adjacent piles of the material
avg travel speed=average speed of travel of the machine For example, for layer 328, the start location may be considered as the location 318 since the machine 100 needs to move back and forth from this location to collect, travel, and further dump the material to form each of the piles in the layer 328. The end location may be considered as the point 332, at which the L1 meets the layer 328, on the basis of the predefined grade of the worksite 300 (see surface 324). The end location for each of the layers may change based on the predefined grade (see surface 324) of the terrain being formed. The distance between two adjacent piles of the material is shown as d in the accompanying figures and is the distance between the start of one pile to the start of the other pile of the material. The average speed of travel is the average speed of the machine 100 while travelling to and from the pick-up and dump locations.

In some embodiments, some or all the data may be received by the controller 202 from the electronic control module (ECM) 206 of the machine 100. Alternatively, the controller 202 may be coupled to any other sensor or sensor module(s) present on the machine 100 for receiving the data related to the dump operations. Further, the data may either be received directly or may be determined indirectly by the controller 202 by computing the desired values from other data available from the machine 100. In one embodiment, some of the data may be obtained by the controller 202 based on the position data of the machine 100 received from the position sensing system 201. More particularly, as the machine 100 moves on the worksite 300 and continues to dump the material, the controller 202 receives the real-time position data associated with the machine 100 from the position sensing system.

As mentioned above, the controller 202 receives the position data related to the machine 100 from the position sensing system 201. The controller 202 receives data indicating the position of the machine 100 at the worksite 300, the position of the blade 102 of the machine 100, the heading and orientation of the machine 100, and so on.

After receiving the information, the controller 202 may compute the stale terrain value associated with the worksite based on the predefined correlation of the different parameters as provided in Equation 1. The controller 202 determines the stale terrain value on a real-time basis for each of the layers thrilled by the machine 100. In some examples, the controller 202 may consider additional parameters, such as a predetermined stale terrain value associated with the worksite while computing a final stale terrain value of the worksite 300 as follows:

$$y = \text{Min}\ (x,\ \text{max (worksite stale terrain thresholds)} \qquad \text{Equation 2}$$

Where:
y=final stale terrain value
x=stale terrain value from Equation 1
worksite stale terrain thresholds=one or more predetermined stale values associated with the worksite In one example, the controller 202 may compute a current terrain value based on real time information received by the controller 202 and compare the current terrain value with the stale terrain value (either x as computed in Equation 1 or y as computed in Equation 2). The controller 202 utilizes information from the position sensing system 201 and the ECM on a real-time basis to compute the current terrain value and determine if the current terrain value is approaching the stale terrain value. If based on the comparison, the controller 202 determines that the machine 100 has approached the stale terrain value, the controller 202 triggers a control signal for shutting down the dump operations of the machine 100.

The controller 202 is coupled to the ECM 206. The controller 202 may send the control signals to the ECM 206 for controlling the operation of the machine 100. More specifically, on approaching the stale terrain value, the controller 202 is configured to shut down the dump operation of the machine 100 until an operator input is provided.

Accordingly, in some embodiments, the controller 202 may be coupled to an input unit (not shown) for example, a joystick, a touch screen, a control panel, and so on for receiving the operator input. Receiving the operator input is indicative that the operator has manually checked and verified the operations of the machine 100 and the terrain characteristics thus far. On receiving the operator input, the machine 100 may restart or continue to perform the dump operations in autonomous mode until the next time-out based on the current terrain value approaching the stale terrain value.

In other embodiments, the controller 202 may be coupled to an output unit (not shown), such as a display screen, a monitor, a speaker, and so on to provide the operator with an auditory and/or visual notification that the current terrain value of the machine 100 has approached the stale terrain value, indicating to the operator that the system has or will shut down and is waiting for the operator to provide the operator input for restarting and/or continuing the operation of the machine 100.

The controller 202 may be a microprocessor or other processor as known in the art. The controller 202 may embody a single microprocessor or multiple microprocessors for receiving signals from components of the engine system 100. Numerous commercially available microprocessors may be configured to perform the functions of the controller 202. A person of ordinary skill in the art will appreciate that the controller 202 may additionally include other components and may also perform other functions not described herein.

INDUSTRIAL APPLICABILITY

Figure 4:
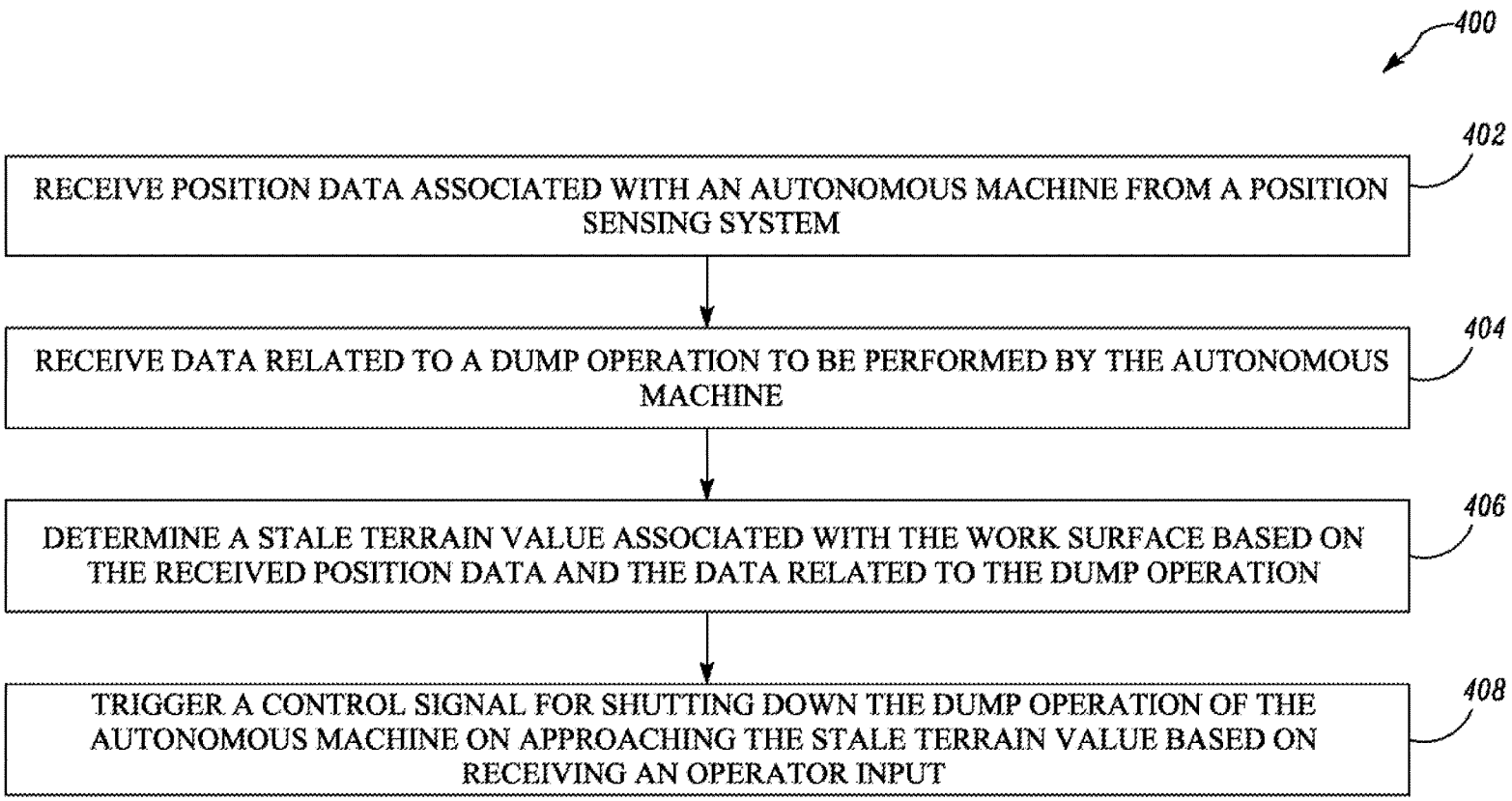
FIG. 4 is a flowchart of a method for determining a stale terrain value associated with the machine, according to various concepts of the present disclosure.

The present disclosure relates to a system and method for controlling an operation of the machine. FIG. 4 illustrates a flowchart of a method 400 for controlling the operation of the machine 100. At step 402, the controller 202 receives position data related associated with the machine 100 from the position sensing system 201. At step 404, the controller 202 receives data related to the dump operation to be performed by the machine 100. The data includes the distance between the start location and the end location, the distance between two adjacent piles of the material, and the average speed of travel of the machine 100. At step 406, the controller 202 determines the stale terrain value associated with the work surface based on the received position data and the data related to the dump operation. At step 408, the controller 202 triggers the control signal for shutting down the dump operation of the machine 100 on approaching the stale terrain value based on receiving the operator input.

The present disclosure provides an effective control for the autonomous dump operations of the machine 100 in which the stress on the operator who is managing a number of the machines 100 at the worksite, may be reduced. The system analyses the dump operations that are performed by the machine 100 over time, and alerts the operator once the stale terrain value is reached, so that the operator is aware of when to manually check the operation of the machine 100 to ensure that the tasks are being performed by the machine 100 as desired. This system may be effective when the operator is single handedly controlling multiple machines, by effectively alerting the operator when to check the operation of any particular machine 100. Further, the system serves as an effective means to check that the changes in the terrain are as per expectations, when multiple machines are operating at the worksite. An overall productivity of the system may be improved by effectively managing activities performed by the machines 100 and keeping a check on the intervention of the operator in the operations of the machine 100.

While aspects of the present disclosure have been particularly shown and described with reference to the embodiments above, it will be understood by those skilled in the art that various additional embodiments may be contemplated by the modification of the disclosed machines, systems and methods without departing from the spirit and scope of what is disclosed. Such embodiments should be understood to fall within the scope of the present disclosure as determined based upon the claims and any equivalents thereof.

What is claimed is:

1. A control system for determining a stale terrain value for use by an autonomous machine, the control system comprising:

a controller associated with the autonomous machine operating on a work surface, the controller configured to:

receive position data associated with the autonomous machine from a position sensing system;

receive data related to a dump operation to be performed by the autonomous machine, the data including a distance between a start location and an end location, a distance between two adjacent piles of material, and an average speed of travel of the autonomous machine;

determine the stale terrain value associated with the work surface based on the received position data and data related to the dump operation; and trigger a control signal for shutting down the dump operation of the autonomous machine on approaching the stale terrain value based on receiving an operator input.

2. The control system of claim 1, wherein the dump operation is a pivot push operation including backstacking of a plurality of piles on the work surface.

3. The control system of claim 1, wherein controller is configured to determine the stale terrain value by computing the stale terrain value based on a predetermined correlation of the data associated with the dump operation.

4. The control system of claim 1, wherein the controller is configured to dynamically determine the stale terrain value for each of a plurality of layers of material formed by the autonomous machine during the dump operation, each of the plurality of layers including a plurality of piles of the material.

5. The control system of claim 1, wherein the controller is further configured to receive information related to a predefined stale terrain value associated with a worksite for determining the stale terrain value associated with the work surface.

6. The control system of claim 1, wherein the controller is further configured to:

receive a current terrain value; and compare the current terrain value with the stale terrain value for determining if the current terrain value is approaching the stale terrain value.

7. The control system of claim 1, wherein the controller is coupled to an input unit, and wherein the controller is further configured to receive the operator input through the input unit.

8. The control system of claim 1, wherein the controller is coupled to an electronic control unit of the autonomous machine.

9. The control system of claim 1, wherein the controller is coupled to an output unit, and wherein the controller is configured to provide a notification to an operator of approaching the stale terrain value associated with the work surface.

10. A method for a stale terrain value associated with an autonomous machine operating on a work surface, the method comprising:

receiving, by a controller, position data associated with the autonomous machine from a position sensing system;

receiving, by the controller, data related to a dump operation to be performed by the autonomous machine, the data including a distance between a start location and an end location, a distance between two adjacent piles of material, and an average speed of travel of the autonomous machine;

determining, by the controller, the stale terrain value associated with the work surface based on the received position data and the data related to the dump operation; and triggering, by the controller, a control signal for shutting down the dump operation of the autonomous machine on approaching the stale terrain value based on receiving an operator input.

11. The method of claim 10, wherein the dump operation is a pivot push operation including backstacking of a plurality of piles on the work surface.

12. The method of claim 10, wherein determining the stale terrain value includes computing the stale terrain value based on a predetermined correlation of the data associated with the dump operation.

13. The method of claim 10 further comprising dynamically determining the stale terrain value for each of a plurality of layers of material formed by the autonomous machine during the dump operation, each of the plurality of layers including a plurality of piles of the material.

14. The method of claim 10 further comprising receiving, by the controller, information related to a predefined stale terrain value associated with a worksite for determining the stale terrain value associated with the work surface.

15. The method of claim 10 further comprising:

receiving, by the controller, a current terrain value; and comparing, by the controller, the current terrain value with the stale terrain value for determining if the current terrain value is approaching the stale terrain value.

16. The method of claim 10 further comprising receiving, by the controller, the operator input through an input unit.

17. The method of claim 10 further comprising providing, by the controller, a notification to an operator of approaching the stale terrain value associated with the work surface.

18. An autonomous machine operating at a worksite, the autonomous machine comprising:

an engine;

a worktool for performing a dump operation; and a control system for determining a stale terrain value for use by the autonomous machine, the control system comprising:

a controller associated with the autonomous machine operating on a work surface, the controller configured to:

receive position data associated with the autonomous machine from a position sensing system;

receive data related to a dump operation to be performed by the autonomous machine, the data including a distance between a start location and an end location, a distance between two adjacent piles of material, and an average speed of travel of the autonomous machine;

determine the stale terrain value associated with the work surface based on the received position data and the data related to the dump operation; and trigger a control signal for shutting down the dump operation of the autonomous machine on approaching the stale terrain value based on receiving an operator input.

19. The autonomous machine of claim 18, wherein the dump operation is a pivot push operation including backstacking of a plurality of piles on the work surface.

20. The autonomous machine of claim 18, wherein the controller is coupled to an output unit, and wherein the controller is configured to provide a notification to an operator of approaching the stale terrain value associated with the work surface.

* * * * *